US007779732B2

(12) United States Patent
Abel et al.

(10) Patent No.: US 7,779,732 B2
(45) Date of Patent: Aug. 24, 2010

(54) SCREWDRIVER HANDLE PROVIDED WITH A BLADE TIP STORAGE CHAMBER

(75) Inventors: Michael Abel, Radevormwald (DE); Ralf-Richard Richter, Wuppertal (DE); Werner Tretbar, Radevormwald (DE); Carsten Wulf, Wuppertal (DE)

(73) Assignee: Wera Werk Hermann Werner GmbH & Co. KG, Wuppertal (DE)

( * ) Notice: Subject to any disclaimer, the term of this patent is extended or adjusted under 35 U.S.C. 154(b) by 100 days.

(21) Appl. No.: 10/562,611

(22) PCT Filed: Jul. 8, 2004

(86) PCT No.: PCT/EP2004/051412

§ 371 (c)(1),
(2), (4) Date: Jun. 2, 2006

(87) PCT Pub. No.: WO2005/005105

PCT Pub. Date: Jan. 20, 2005

(65) Prior Publication Data

US 2007/0012144 A1 Jan. 18, 2007

(30) Foreign Application Priority Data

Jul. 10, 2003 (DE) ..... 103 31 221
Mar. 11, 2004 (DE) ..... 10 2004 011 892

(51) Int. Cl.
*B25B 23/16* (2006.01)

(52) U.S. Cl. ..... 81/177.4; 81/490

(58) Field of Classification Search ..... 81/177.4, 81/490, 437–439
See application file for complete search history.

(56) References Cited

U.S. PATENT DOCUMENTS

| | | | | |
|---|---|---|---|---|
| 4,934,223 | A | 6/1990 | Wong | |
| 5,265,504 | A | 11/1993 | Fruhm | |
| 5,517,885 | A * | 5/1996 | Feng | 81/177.4 |
| 6,155,143 | A * | 12/2000 | Wu | 81/436 |
| 6,431,034 | B1 | 8/2002 | Chen | |
| 6,629,478 | B2 | 10/2003 | Kozak | |
| 2004/0025650 | A1 * | 2/2004 | Hu | 81/490 |
| 2004/0094000 | A1 * | 5/2004 | Liao | 81/490 |

FOREIGN PATENT DOCUMENTS

| | | |
|---|---|---|
| DE | 3004958 | 8/1981 |
| DE | 8404176 | 5/1984 |
| DE | 296 08 633 U | 8/1996 |
| DE | 29714974 | 8/1997 |
| DE | 200 12 953 U | 9/2000 |
| DE | 200 15 484 | 11/2000 |
| EP | 0792 725 A | 9/1997 |

* cited by examiner

*Primary Examiner*—D. S Meislin
(74) *Attorney, Agent, or Firm*—Lucas & Mercanti, LLP; Klaus P. Stoffel

(57) ABSTRACT

Screwdriver handle has a storage chamber for screwdriver bits, the storage chamber being displaceable from a closed position into an open position by axial displacement of two parts of the handle with respect to one another. One handle part has a core, which is disposed in a cavity in the other handle part. The two handle parts are held in the closed position of the storage chamber by latching means movable out of a latching position by pressure on an actuating zone (8) associated with an end side of the handle.

15 Claims, 6 Drawing Sheets

SCREWDRIVER HANDLE PROVIDED WITH A BLADE TIP STORAGE CHAMBER

FIELD AND BACKGROUND OF THE INVENTION

The invention relates to a handle of a screwdriver having a storage chamber for screwdriver bits or the like, the storage chamber being displaceable from a closed position into an open position by axial displacement of two handle parts with respect to one another, one handle part having a core, which is disposed in a cavity in the other handle part, and the two handle parts being held in the closed position of the storage chamber by latching means.

A handle of this type for a screwdriver, or a screwdriver having a handle of this type, is already known from U.S. Pat. No. 5,265,504. The handle has two handle parts. These handle parts can be pulled apart in order to open a storage chamber. Screwdriver inserts, known as bits, are located in the storage chamber and can then be removed. One of the two handle parts, namely the one which carries the blade, has a cavity. In the closed position, the core of the other handle part fits into this cavity. Around the core there are a plurality of compartments for receiving the screwdriver bits. In the closed position, a latching cam engages behind a latching shoulder.

U.S. Pat. No. 6,629,478 B2 has disclosed a screwdriver handle in which a handle part which carries the blade has insertion openings for the insertion of screwdriver bits. This handle part can be pushed into the cavity of another handle part, which forms the end side of the handle, counter to the force of a compression spring. The end side of the handle has an opening for receiving a screwdriver bit or a smaller handle which carries a screwdriver bit.

DE 8404176.5 U1 has disclosed a screwdriver handle which is hollow. The cavity that is open towards the end side of the handle is covered by a cap which forms a cover. To actuate a pressure zone, it is possible to displace a latching tongue of the cover in order to open the latter. Then, screwdriver blades disposed in the cavity can be removed.

DE 20015484 U1 has disclosed a handle for a screwdriver, in which the handle has two handle parts that can pivot open about a pivot axis parallel to the handle axis. The handle parts form cavities into which tools and also screwdriver bits can be fitted. The two handle parts are latched closed by a closure tab.

U.S. Pat. No. 4,934,223 describes a screwing tool resembling a piston grip, with a magazine which is disposed in the grip and can be pulled out through an end-side opening in the grip. Screwdriver bits fit into the magazine.

DE 29714974 U1 describes a handle of a screwdriver which comprises two parts fitted into one another. A handle part which includes a cavity has an opening into which a second handle part, which carries the blade, is fitted in its entirety. The handle part which carries the blade stores screwdriver bits.

Working on the basis of the prior art described in the introduction, the invention is based on the object of further developing the handle of the generic type in a manner advantageous for use. The object is achieved by the invention described in the claims.

SUMMARY OF THE INVENTION

The invention provides first and foremost that the latching means can be moved out of their latching position by pressure on an actuating zone associated with the end side of the handle. The handle is preferably elongate in form, with two end sides that face away from one another. The blade or a blade holder can project out of one end side. The other end side forms a handle cup which lies in the palm of the hand when the handle is gripped as it is taken hold of. In a first variant of the invention, this end side of a screwdriver handle, which is also referred to as the cup, is to form the actuating zone. It is preferable for the actuating zone to be formed by a push-button. This push-button is preferably located in a pot-shaped cutout in the end side of the handle. The end face of the push-button may in this case have a central hollow.

The edge of this hollow may project beyond the opening edge of the cutout. The push-button preferably has soft or rounded edges, such that it does not dig into the user's hand to a disruptive extent when the handle is gripped. In a preferred configuration of the invention, the latching of the two handle parts is only eliminated when the push-button has been displaced a certain distance into the cutout. The latching is cancelled in particular when the end face of the push-button is located below the opening edge of the cutout. This configuration effectively avoids inadvertent cancelling of the latching. The latching means may be a spring tongue which has a latching projection at its free end and which interacts with a latching step. The spring tongue may in this case be associated with the core part and the latching step with the handle part that includes the cavity. In this case, the spring tongues, which may be formed integrally with the material of the core, project in the axial direction from the end portion of the core. It is possible to provide a plurality of spring tongues located diametrically opposite one another. It is preferable for these spring tongues to be displaced by actuating cams of the push-button. For this purpose, the spring tongues may have control slopes which are acted on in a corresponding way by the actuating cam or a differently configured actuating element of the push-button. It is preferable for the two handle parts to be displaceable from the closed position into the open position by the force of a prestressed spring after pressure on the actuating zone. The spring force is less than the latching force of the latching means. The spring stress can only be relieved after actuation of the push-button. In this case, in a preferred variant of the invention, the two handle parts are moved apart until they reach a stop position, in which the screwdriver bits located in the storage chamber can be removed.

The object is also achieved by further embodiment of the invention, which provides first and foremost that the latching means leaves its latching position through pressure on an actuating zone. The mating catch may be a latching step. The actuating zone may be associated with the handle part that includes the cavity. According to the invention, the cancelling of the latching, which is a precondition for the two handle parts to be moved apart, can only be done deliberately by pressing on the actuating zone. In a preferred refinement of the invention, it is provided that the latching means is a pivotable spring tongue which has a latching projection at its free end. This spring tongue is located with its latching projection in front of a step of the handle part that includes that cavity. Only when the spring tongue is displaced radially inward, so that the latching projection is moved out of the path of movement of the latching step, can the two handle parts be moved axially apart in order for the storage chamber to be opened. For the radial displacement of the latching projection, it is necessary to press on the actuating zone. This pressure continues through the wall of the cavity on to the spring tongue. It is preferable for the actuating zone to be formed by a soft plastic inlay in the outer wall of the handle part that includes the cavity. It is advantageous if two latching means, each with an associated actuating zone, are located diametrically opposite one another. The two actuating zones are then offset by 180° with respect to one another. When the screwdriver handle is gripped, there is no harm if pressure is applied to just one of the two actuating zones during the screwing action. It has been found that in the standard grip positions of the hand, a diametral pressure is not exerted with respect to the handle. When the handle is gripped, the thumb presses against the handle lateral surface on one side. The handle is held by the index finger on the diametrically opposite side. In this case, the zone of the handle lateral surface which lies diametrically opposite the thumb is in the joint crook between the second and third phalanxes of the index finger. Even if the handle is gripped from above, no two diametrically opposite zones are subject to the application of pressure. The axial portion in which the two diametrically opposite actuating zones are located is held between thumb, index finger and ring finger in a three-point grip. In a refinement of the invention, it is provided that the spring tongue is formed integrally with the material of the core. In this case, the spring tongue may be formed by a wall section of a wall of a compartment for receiving a screwdriver bit. Furthermore, it is advantageous if the application of radial force to the latching means does not take place directly via the soft plastic inlay, but rather via an actuating arm and an actuating cam formed by it. The actuating cam in this case presses on the spring tongue in order to pivot it. The actuating arm may be formed by a U-shaped cut-free part of a hard plastic sleeve which forms the grip part that includes the cavity.

Overall, however, the object is also achieved by yet another embodiment of the invention as described hereinafter.

The two handle parts may be spring-loaded with respect to one another in such a manner that, after the cancelling of the latching, they are displaced by a compression spring, which is stressed in the closed position, as a result of the stresses in the compression spring being relieved, until they reach an open position. It is preferable for the two handle parts only to be displaced into a partially open position. The compression spring can be supported on the base of the cavity and on the end side of the core. The compression spring can be secured at the base of the cavity by means of a centering projection. The other end of the compression spring can project into a guide recess in the end side of the core. In a refinement of the invention, it is provided that the two handle parts latch together in the fully open position. The latching is in this case achieved with the aid of the actuating cam of the actuating arm. During the opening displacement, it is lifted over the latching cam. To displace the two handle parts from the fully open position back toward the closed position, the actuating cam has to be lifted over the latching cam by the application of an axial force. In the fully open position, the actuating cam comes to a stop against a stop. This stop cannot be overcome in the axial separating direction of the two handle parts. However, plug-assembly of the two handle parts is possible on account of rear-side slopes of the actuating cam, on the one hand, and of the stop, on the other hand, interacting with one another. It is preferable for the handle part which includes the core to be provided with a blade or with an exchangeable shank. The handle part which includes the cavity is preferably provided, as a sleeve part, with a handle cup.

In principle, the object on which the invention is based is achieved by each of the claims individually.

BRIEF DESCRIPTION OF THE DRAWINGS

Exemplary embodiments are explained below with reference to the accompanying drawing, in which.

DETAILED DESCRIPTION OF THE PREFERRED EMBODIMENT(S)

Figure 1:
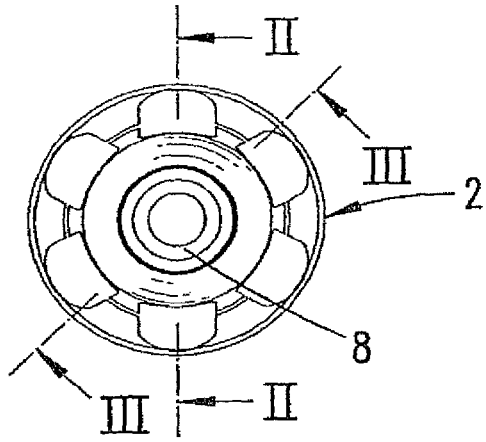
FIG. 1 shows the end view of an exemplary embodiment of the invention.
Figure 2:
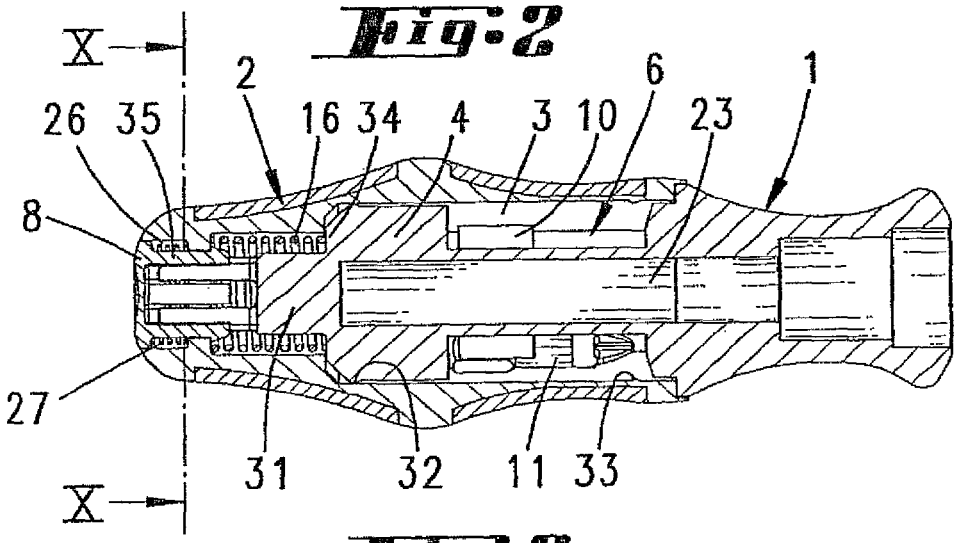
FIG. 2 shows a section on line II-II in FIG. 1 in the latching position, in which the storage chamber is closed.
Figure 3:
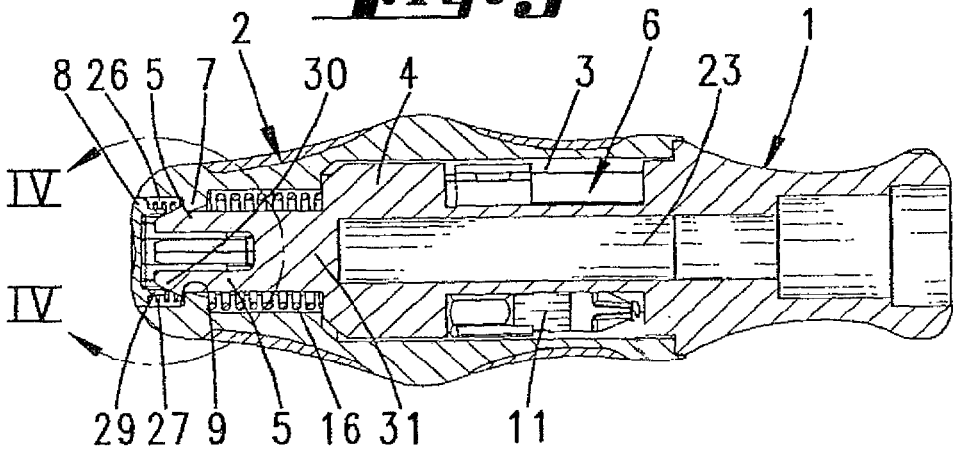
FIG. 3 shows a section on line III-III in FIG. 1, likewise in the closed position.
Figure 4:
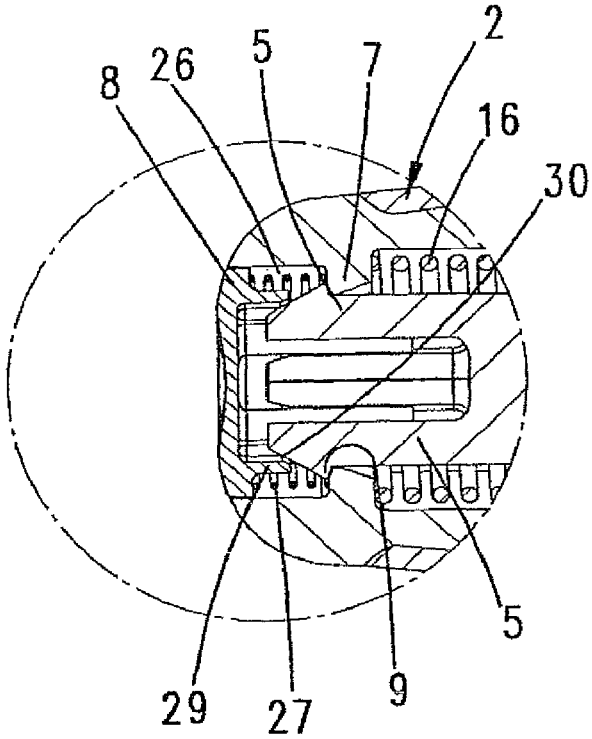
FIG. 4 shows an enlarged excerpt from FIG. 3 corresponding to line IV-IV.

The handle illustrated in FIGS. 1 to 7 can be provided with a fixed blade or an exchangeable shank. The blade or the exchangeable shank is accommodated in a blade receiving part 23. The way in which the exchangeable shank in question here functions is described in detail in DE 10233866.3.

The handle substantially comprises two parts. Handle part 1 is a core part. Handle part 2 is a sleeve part. There is a cavity 3 in the sleeve part 2.

The handle part 1 has a core 4 which receives the blade or the exchangeable shank. In the closed position illustrated in FIG. 3, this core is located entirely within the cavity 3. On the outer side, the core has a plurality of compartments running in the axial direction. In each of these compartments there is a screwdriver bit 11. In the open position of the storage chamber 6 formed by these compartments (cf. FIG. 6), the screwdriver bits can be removed or inserted again.

In the case of the handle illustrated in FIGS. 1 to 10, the latching is cancelled by pressure on a push-button 8 which is associated with the end side of the handle part 2. The handle part 2 has an inner cavity 3. The core 4 of a second handle part 1 fits into this cavity 3. The core 4 has circumferentially disposed receiving chambers 6 for screwdriver bits 11. The individual storage chambers 6 are separated from one another by means of walls. Furthermore, the core 4 has a cavity for the insertion of a blade. The core 4 also has a rear axial extension 31, from which a total of four diametrically opposite spring tongues 5 originate. Each spring tongue forms a latching projection 9 (FIGS. 8-9) with a control slope 30. The axial extension 31 fits inside a compression coil spring 16, the end of which is supported on a shoulder 34 of the core 4. The other end of the compression coil spring 16 is supported on the base of the cavity 3. The core 4 is spring-loaded in the direction of the opening of the cavity 3 in the handle part 2 by means of the compression spring 16.

The core has a radially protruding stop 32 in the form of a projection. In the same axial position with respect to the stop 32, the cavity 3 also has a stop 33, against which the stop 32 strikes when the spring 16 has pressed the two handle parts 1, 2 apart. The stop 33 projects radially inward from the wall of the cavity 3. The core 4 is mounted axially displaceably but non-rotatably in the cavity 3. As a result, torques can be transmitted from the handle part 2 to the handle part 1.

Figure 9:
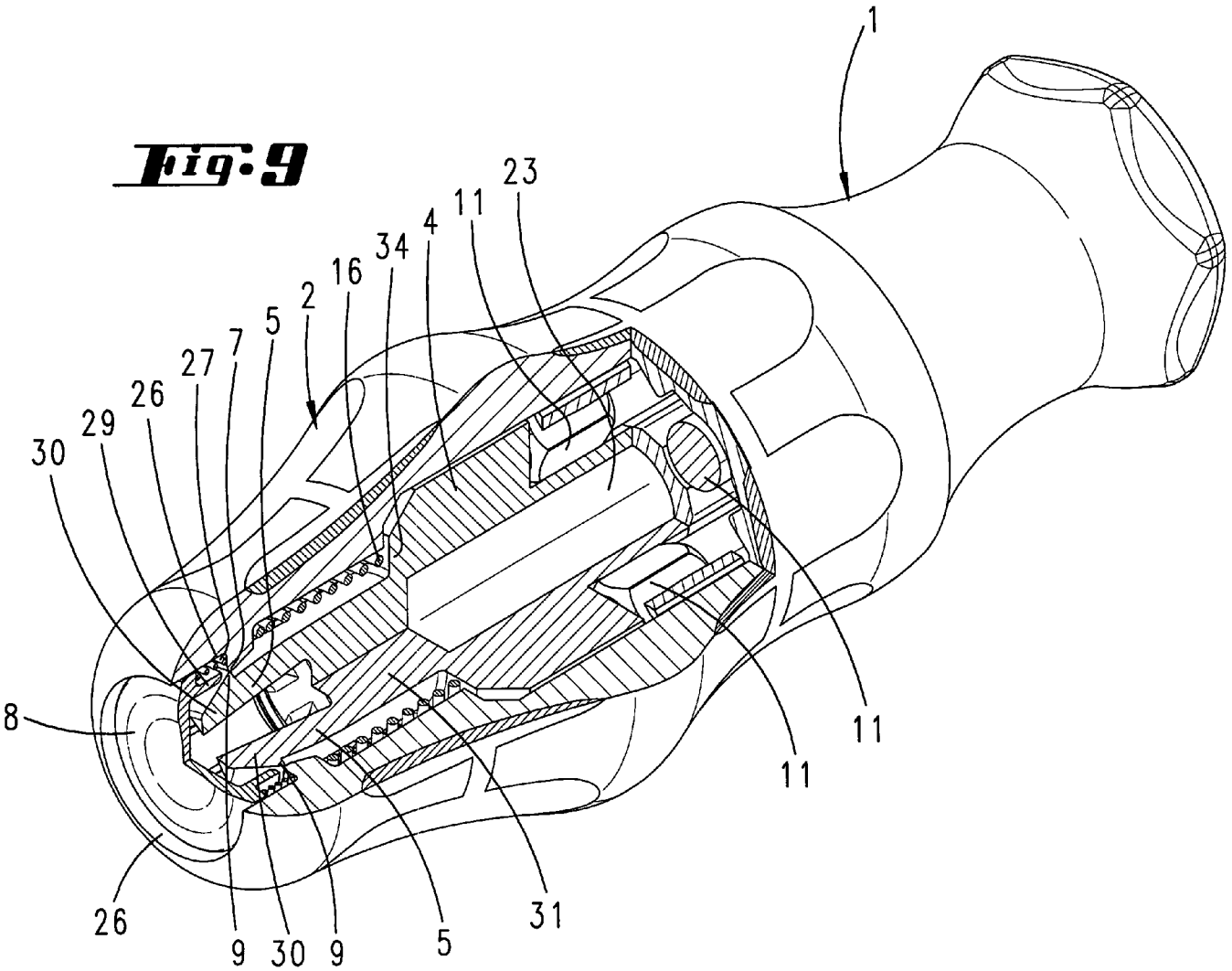
Figure 10:
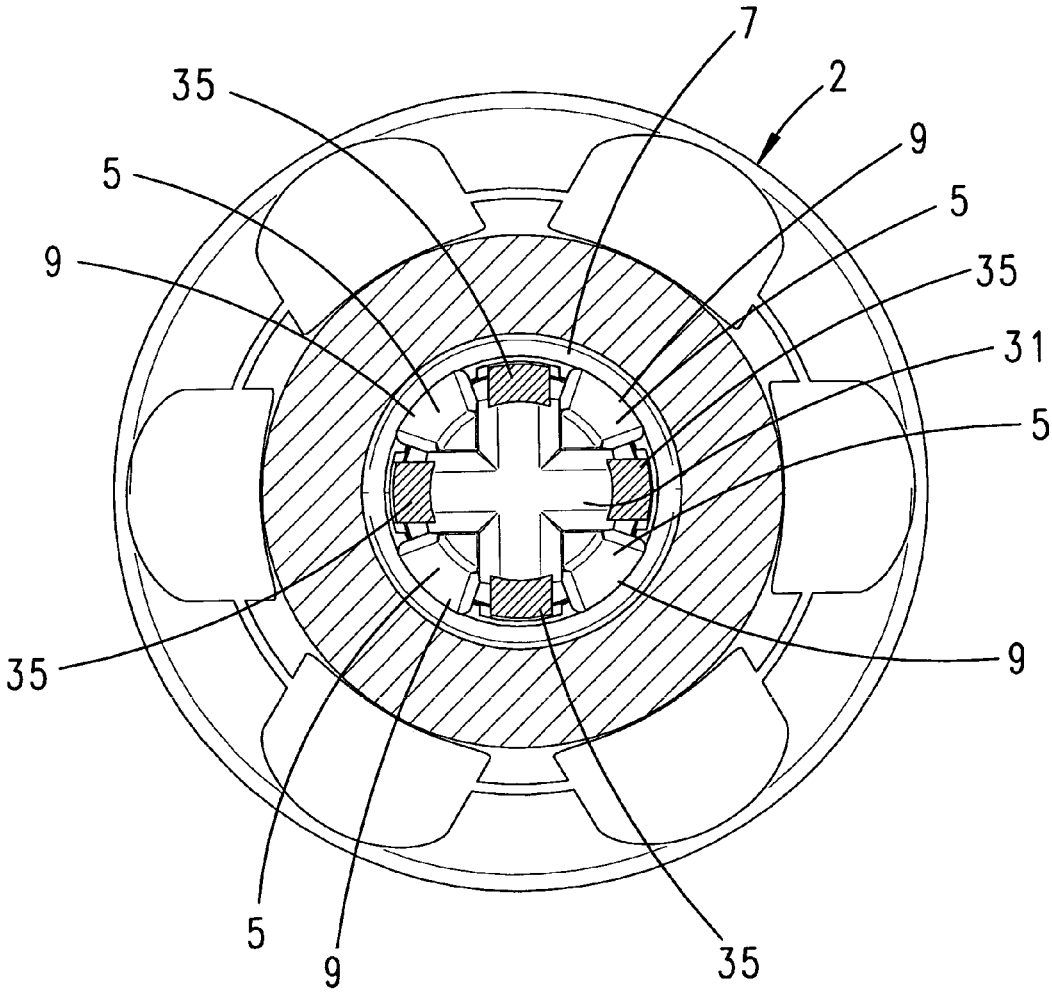
FIG. 10 is an end view of the handle, partially sectioned to show interior components of the handle.

That end of the handle part 2 which forms the cup of the handle part 2 has a pot-shaped cutout 26 (FIG. 9). The base of the pot-shaped cutout 26 has a central aperture, through which holding arms 35 (FIGS. 2, 10) of a push-button, which is spring-loaded in the opening direction of the cutout 26 by means of a compression spring 27, protrude. Hook-like end portions of the holding arms are responsible for axially holding the push-button 8 in the cutout 26 associated with it.

Axially offset with respect to the holding arms 35, actuating cams of the push-button 8 protrude into the cutout 26. In the closed position, these actuating cams 29 are located in front of the end-side control slopes 30 of the spring tongues 5. In the closed position, the end portions, forming the latching projection 9, of the spring tongues project through the base opening of the cutout 26 into the cutout 26, in such a manner that the latching projections 9 engage over the edge of the base opening. These zones over which the latching projections 9 have engaged form a latching step 7.

Figure 5:
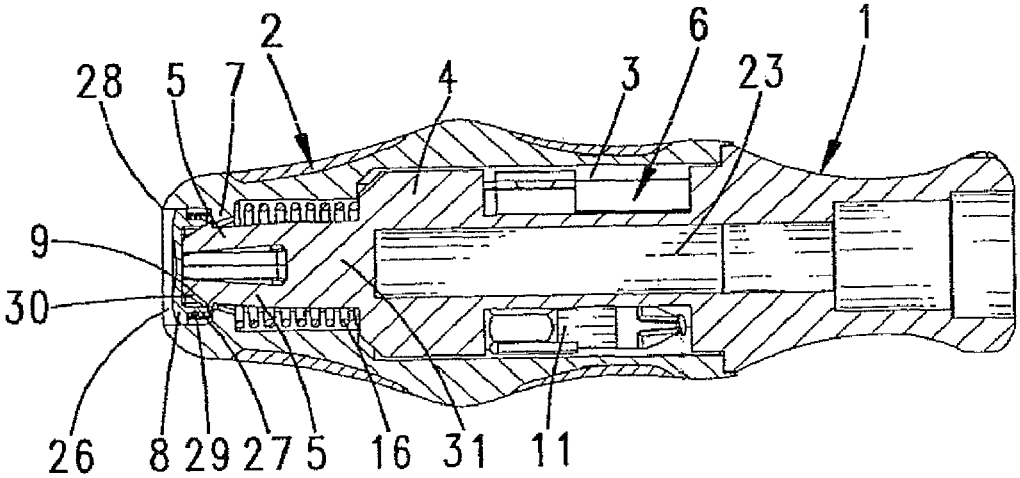
FIG. 5 shows an illustration corresponding to FIG. 3 with the end-side push-button depressed.

In the closed position (FIGS. 2, 3), the compression spring 16 is stressed. If the push-button is pressed in this state, as shown in FIG. 5, the control slopes 30 of the spring tongues 15 are acted on by the actuating cams 29. Pressing the push-button 8 causes the end edge of the actuating cam to slide along the control slope 30. In association with this sliding movement, the end portion of the spring tongue 5 is displaced radially inward. As long as the end face of the push-button 8 is above the opening edge 28 of the cutout, the latching projections 9 engage behind the latching steps 7 associated with them. Only when the end face of the push-button 8 is entirely within the cutout 26 are the spring tongues 5 bent radially inward to such an extent that the latching projections 9 are moved out of latching engagement with respect to the latching steps. Then, the stress in the compression spring 16 is relieved, and the compression spring displaces the handle part 1 which includes the core 4 into the open position illustrated in FIGS. 6 and 7, in which the stops 32, 33 are in contact with one another. In this open position, the compression spring 16 still has a small residual stress.

Figure 6:
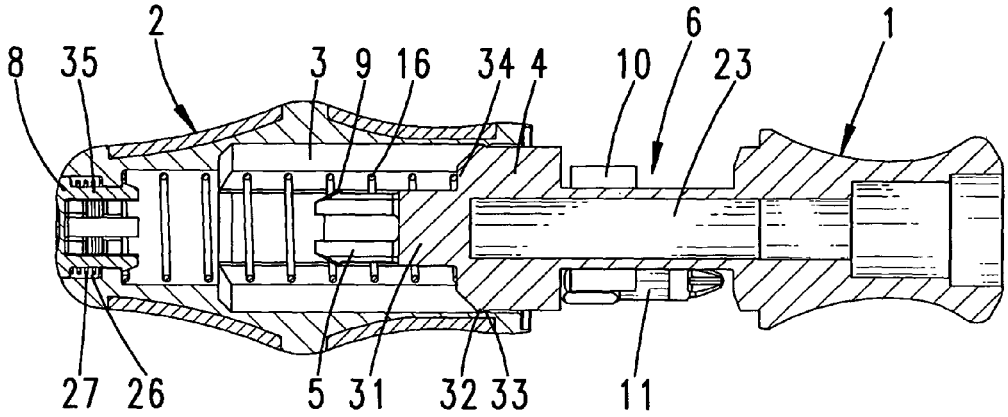
FIG. 6 shows an illustration corresponding to FIG. 2 in the open position.
Figure 7:
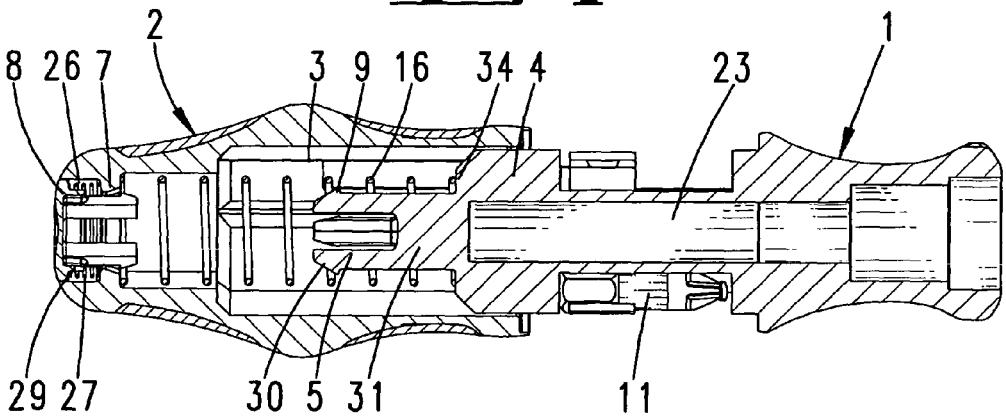
FIG. 7 shows an illustration corresponding to FIG. 3 in the open position.
Figure 8:
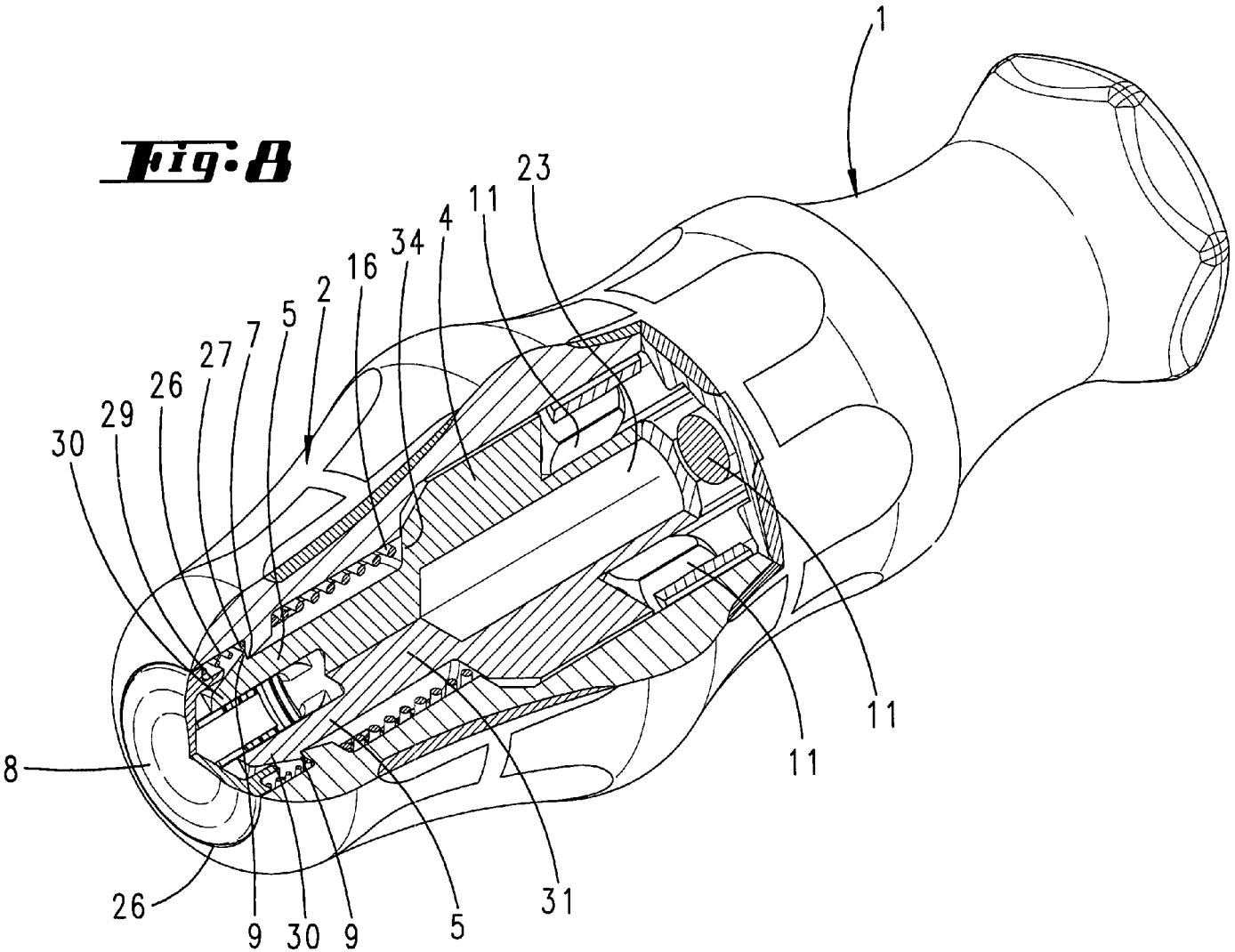
FIGS. 8-9 show perspective views of the handle with an axial portion being cut away to show interior components of the handle.

If, starting from the open position illustrated in FIGS. 6 and 7, the core 4 is pushed back into the cavity, the compression spring 16 is stressed. The control slopes 30 act on inclined control surfaces of the latching step 7. In the final phase of the insertion movement of the core 4 into the cavity 3, the latching projections 9 engage behind the latching steps 7 associated with them. In the process, the control slopes 30 slide along the latching step 7 until they engage behind the latching step 7 with a snap action.

We claim:

1. Handle of a screwdriver, the handle comprising a first handle part, a second handle part, and a storage chamber for screwdriver bits or the like, the storage chamber being displaceable within the handle from a closed position into an open position by axial displacement of the two handle parts with respect to one another, the first handle part having a core, which is disposed in a cavity in the second handle part, and the two handle parts being held in the closed position of the storage chamber by latching means, wherein the latching means is movable out of its latching position by pressure on an actuating push button located on an end of the second handle part wherein the push button is configured so as to be axially displaceable when under pressure in a direction toward the first handle part, wherein the push-button is fitted in a cutout in the end side of the handle, wherein the latching means is a pivotable spring tongue which has a latching projection at its free end and interacts with a latching step, and wherein an actuating cam is formed by the push-button and acts on the spring tongue in order to cancel the latching position.

2. Handle according to claim 1, wherein the push-button is displaceable into a pot-shaped cutout counter to the force of a restoring spring.

3. Handle according to claim 1, wherein in the event of pressure on the push-button, the latching means is moved out of the latching position when the end face of the push-button is displaced past an opening edge of a cutout.

4. Handle according to claim 1, wherein the spring tongue is formed integrally with the material of the core.

5. Handle according to claim 1, wherein the spring tongue is formed by an end portion of the core.

6. Handle according to claim 1, wherein said latching means is one of a plurality of latching means located diametrically opposite one another.

7. Handle according to claim 1, wherein the actuating cam acts in the axial direction on a control slope of the spring tongue, which likewise extends in the axial direction.

8. Handle according to claim 1, wherein the two handle parts are displaced from the closed position into the open position by the force of a prestressed spring following pressure on the actuating zone.

9. Handle of a screwdriver, the handle comprising a first handle part, a second handle part, and a storage chamber for screwdriver bits or the like, the storage chamber being openable by axial displacement of the two handle parts with respect to one another, the first handle part having a core which is disposed in a cavity in the second handle part and has at least one latching means, which latching means, in a closed position of the storage chamber, interacts with a mating catch of the second handle part that includes the cavity, wherein the latching means leaves its latching position of its own accord as a result of pressure on an actuating zone of the first handle part which includes the mating catch, wherein the actuating zone is associated with the second handle part which includes the cavity, and the latching means is a pivotable spring tongue which has a latching projection at its free end and is formed integrally with the material of the core.

10. Handle according to claim 9, wherein the mating catch is a latching step.

11. Handle of a screwdriver, the handle comprising a first handle part, a second handle part, and a storage chamber for screwdriver bits or the like, the storage chamber being openable by axial displacement of the two handle parts with respect to one another, the first handle part having a core which is disposed in a cavity in the second handle part and has at least one latching means, which latching means, in a closed position of the storage chamber, interacts with a mating catch of the second handle part that includes the cavity, wherein the latching means leaves its latching position of its own accord as a result of pressure on an actuating zone of the first handle part which includes the mating catch, wherein the latching means is one of two latching means located diametrically opposite one another.

12. Handle of a screwdriver, the handle comprising a first handle part, a second handle part, a spring, and a storage chamber for screwdriver bits or the like, the storage chamber being openable by axial displacement of the two handle parts with respect to one another, the first handle part having a core, which is disposed in a cavity in the second handle part and has at least one latching means, which latching means, in a closed position of the storage chamber, interacts with a mating catch of the second handle part that includes the cavity, wherein the two handle parts are spring-loaded with respect to one another in such a manner that, after a latching has been cancelled, the two handle parts are moved apart by the spring, until they reach an open position, and wherein a push-button is provided for the cancellation of the latching when the button is pressed along a direction that is coaxial with the handle.

13. Handle according to claim 12, wherein the spring is a compression spring, and is stressed in a closed position of the handle parts.

14. Handle according to claim 12, wherein the open position is a partially open position.

15. Handle of a screwdriver, the handle comprising a first handle part, a second handle part, and a storage chamber for screwdriver bits or the like, the storage chamber being displaceable within the handle from a closed position into an open position by axial displacement of the two handle parts with respect to one another, the first handle part having a core, which is disposed in a cavity in the second handle part, and the two handle parts being held in the closed position of the storage chamber by a latch mechanism that comprises a cantileverable spring tongue which has a latching projection at its free end and which interacts with a latching step, wherein the latch mechanism is movable out of its latching position by pressure on an actuating push button located on an end of the second handle part wherein the push button is configured so as to be displaced under pressure in the direction of the first handle part, and wherein an actuating cam is formed by the push-button and acts on the spring tongue in order to cancel the latching position.

* * * * *